US010814377B2

(12) United States Patent
Breneman et al.

(10) Patent No.: US 10,814,377 B2
(45) Date of Patent: Oct. 27, 2020

(54) METHOD FOR CASTING SHELL DEWAXING

(71) Applicant: United Technologies Corporation, Farmington, CT (US)

(72) Inventors: Ryan C. Breneman, West Hartford, CT (US); Steven J. Bullied, Pomfret Center, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 515 days.

(21) Appl. No.: 15/635,622

(22) Filed: Jun. 28, 2017

(65) Prior Publication Data

US 2019/0001400 A1 Jan. 3, 2019

(51) Int. Cl.

| | |
|---|---|
| ***B22C 9/04*** | (2006.01) |
| ***B22C 9/10*** | (2006.01) |
| ***B22D 29/00*** | (2006.01) |

(52) U.S. Cl.

CPC ..... *B22C 9/043* (2013.01); *B22C 9/10* (2013.01); *B22D 29/001* (2013.01)

(58) Field of Classification Search

CPC .. B22C 9/04; B22C 9/043; B22C 9/10; B22D 29/00; B22D 29/001

USPC ..... 164/23, 34, 35, 45, 132

See application file for complete search history.

(56) References Cited

U.S. PATENT DOCUMENTS

| | | | |
|---|---|---|---|
| 4,141,781 | A | 2/1979 | Greskovich et al. |
| 4,854,368 | A | 8/1989 | Vezirian |
| 6,241,000 | B1 | 6/2001 | Conroy et al. |
| 6,739,380 | B2 | 5/2004 | Schlienger et al. |
| 6,951,239 | B1 | 10/2005 | Snyder et al. |
| 7,201,212 | B2 | 4/2007 | Bullied et al. |
| 7,207,375 | B2 | 4/2007 | Turkington et al. |
| 7,231,955 | B1 | 6/2007 | Bullied et al. |
| 7,240,718 | B2 | 7/2007 | Schmidt et al. |
| 2009/0294086 | A1 | 12/2009 | Yang |
| 2014/0262106 | A1 | 9/2014 | Farkas |

FOREIGN PATENT DOCUMENTS

| | | | |
|---|---|---|---|
| CN | 104353779 | A | 2/2015 |
| EP | 1600229 | A1 | 11/2005 |

OTHER PUBLICATIONS

European Search Report dated Aug. 28, 2018 for European Patent Application No. 18180485.7.

*Primary Examiner* — Kevin P Kerns

(74) *Attorney, Agent, or Firm* — Bachman & LaPointe, P.C.

(57) ABSTRACT

In a method for removing a carbon-containing pattern material from a casting shell, a first step evaporates and pyrolizes the pattern material to leave carbon and a second step oxidizes the carbon.

20 Claims, 6 Drawing Sheets

METHOD FOR CASTING SHELL DEWAXING

BACKGROUND

The disclosure relates to investment casting. More particularly, the disclosure relates to the removal of wax patterns from casting shells.

Investment casting is commonly used in the aerospace industry. Various examples involve the casting of gas turbine engine parts. Exemplary parts include various blades, vanes, seals, and combustor panels. Many such parts are cast with cooling passageways. The passageways may be formed using sacrificial casting cores. See, generally, U.S. Pat. Nos. 6,951,239, 7,201,212, 7,207,375, and 7,231,955

Exemplary cores include ceramic cores, refractory metal cores (RMCs), and combinations thereof. In exemplary combinations, the ceramic cores may form feed passageways whereas the RMCs may form cooling passageways extending from the feed passageways through walls of the associated part. The core(s) are overmolded with wax generally in the form of the ultimate metallic part to be cast, plus gating and other features. The overmolded core(s) form a pattern which is then shelled with a stucco slurry.

Depending on the nature of the part and casting alloy, there are numerous variations. These variations include assembling other molded wax pieces to the pattern prior to shelling (e.g., via wax welding). Such pieces include pieces for forming grain starters, or vents or gating or the like. There also may be attachments of metallic seeds, although seeds may alternatively be installed once the shell is formed.

In a multi-stage process, the slurry is dried and hardened and the wax is removed. Multiple shells may be assembled with a pre-formed manifold and pour cup for receiving the alloy (e.g., a nickel- or cobalt-based superalloy).

After the casting of the part, the casting shell and core(s) are destructively removed. Exemplary shell removal is principally mechanical. Exemplary core removal is principally chemical. For example, the cores may be removed by chemical leaching. Exemplary leaching involves use of an alkaline solution in an autoclave. Exemplary leaching techniques are disclosed in U.S. Pat. Nos. 4,141,781, 6,241,000, and 6,739,380. A thermochemical leaching is disclosed in U.S. Pat. No. 7,240,718.

SUMMARY

One aspect of the disclosure involves a method for removing a carbon-containing pattern material from a casting shell. The method comprises a first heating and a second heating after the first heating. The first heating has a lower minimum pressure than the second heating.

In one or more embodiments of any of the other embodiments, the first heating is at a minimum pressure of less than 1.3 Pa.

In one or more embodiments of any of the other embodiments, the first heating is at a lower median oxygen partial pressure than a median oxygen partial pressure of the second heating.

In one or more embodiments of any of the other embodiments, the first heating peak temperature is at least 816° C.

In one or more embodiments of any of the other embodiments, the pattern material consists essentially of wax.

In one or more embodiments of any of the other embodiments, the first heating peak temperature is 816° C. to 1093° C. and the second heating peak temperature is 649° C. to 982° C.

In one or more embodiments of any of the other embodiments, the first heating is in a first furnace and the second heating is in a second furnace, different from the first furnace.

In one or more embodiments of any of the other embodiments, the shell contains a casting core.

In one or more embodiments of any of the other embodiments, the casting core is a ceramic casting core.

In one or more embodiments of any of the other embodiments, the method is used to manufacture a gas turbine engine component.

In one or more embodiments of any of the other embodiments, a casting method includes the method for removing the carbon-containing pattern material. The method further comprises: molding the pattern material over a casting core to form a pattern; forming the shell over the pattern; after the removing, casting a metallic material in the shell around the casting core; and destructively removing the shell and casting core to leave a cast part.

In one or more embodiments of any of the other embodiments, the cast part consists essentially of a nickel-based superalloy.

Another aspect of the disclosure involves a method for removing a carbon-containing pattern material from a casting shell. The method comprises a first step for evaporating and pyrolizing the pattern material to leave carbon and a second step, for oxidizing the carbon.

In one or more embodiments of any of the other embodiments, the first step includes applying vacuum.

In one or more embodiments of any of the other embodiments, the second step includes introducing oxygen.

In one or more embodiments of any of the other embodiments, the first step comprises exposing the shell to a pressure of less than 1.3 Pa while at a temperature of at least 816° C.

In one or more embodiments of any of the other embodiments, the second step comprises exposing the shell to an oxygen partial pressure of at least 10 kPa while at a temperature of at least 649° C.

In one or more embodiments of any of the other embodiments, the pattern material comprises a wax.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
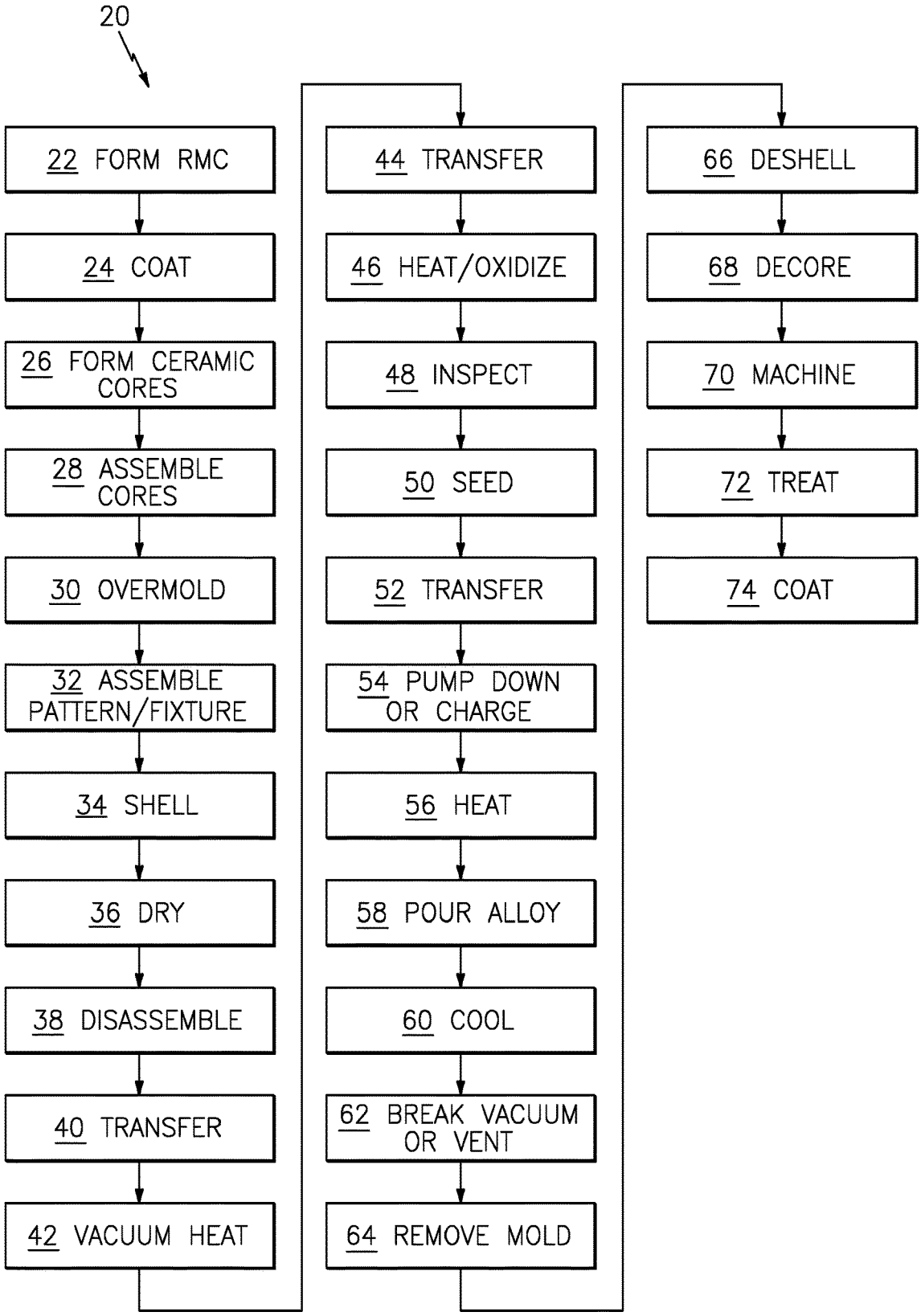
FIG. 1 is a flowchart of an investment casting process.

FIG. 1 shows an exemplary method 20 for forming an investment casting mold. Other methods are possible, including a variety of prior art methods and yet-developed methods. The overall method merely places a particular dewaxing process in context.

One or more metallic core elements may be formed 22 (e.g., of refractory metals such as molybdenum and niobium by stamping or otherwise cutting from sheet metal) and coated 24. Suitable coating materials include silica, alumina, zirconia, chromia, mullite and hafnia. Preferably, the coefficient of thermal expansion (CTE) of the refractory metal and the coating are similar. Coatings may be applied by any appropriate line-of sight or non-line-of sight technique (e.g., chemical or physical vapor deposition (CVD, PVD) methods, plasma spray methods, electrophoresis, and sol gel methods). Individual layers may typically be 0.1 to 1 mil thick. Layers of Pt, other noble metals, Cr, Si, W, and/or Al, or other non-metallic materials may be applied to the metallic core elements for oxidation protection in combination with a ceramic coating for protection from molten metal erosion and dissolution.

One or more ceramic cores may also be formed 26 (e.g., of or containing silica in a molding and firing process). One or more of the coated metallic core elements (hereafter refractory metal cores (RMCs)) are assembled 28 to one or more of the ceramic cores. The core assembly is then overmolded 30 with an easily sacrificed material such as a natural or synthetic wax (e.g., via placing the assembly in a mold and molding the wax around it). There may be multiple such assemblies involved in a given mold. An exemplary wax is a mixture of hydrocarbon wax (e.g., paraffin wax, natural wax, and/or carboxylic wax), hydrocarbon resins (e.g., rosin ester resins), oils, dyes, and plasticizers (e.g., Bisphenol-A). The wax may be a filled wax (e.g. serving as a matrix for polymer (e.g., polystyrene beads).

Figure 2:
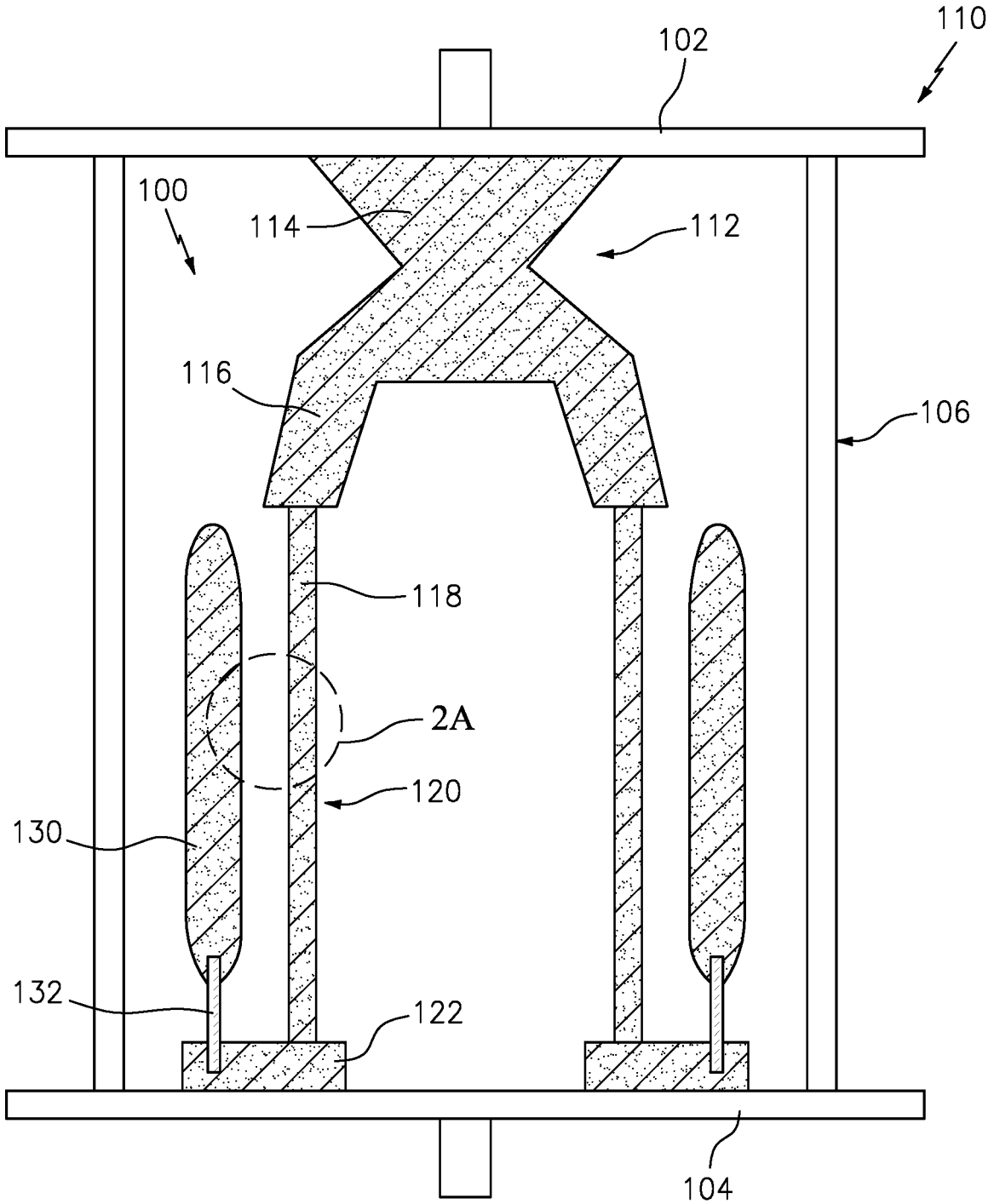
FIG. 2 is a partially schematic vertical sectional view of a pattern assembly in a shelling fixture.

The overmolded core assembly (or group of assemblies) forms a casting pattern with an exterior shape largely corresponding to the exterior shape of the part to be cast. The pattern may then be assembled 32 to a shelling fixture (e.g., via wax welding between end plates of the fixture). As is discussed above, the assembling 32 may also include assembling additional molded wax pieces for forming grain starters, vents, gating, or the like. These may be pre-molded of the wax. FIG. 2 shows an exemplary pattern assembly 100 between a top plate 102 and a base plate 104 of a shelling fixture 110. The exact configuration of the pattern assembly (and resulting shell) and the fixture may be influenced by the nature of the particular parts to be cast (including shape, intended crystalline structure, and the like) and the casting technique (which may also relate to the particular crystalline structure). The exemplary fixture is generally consistent with directionally solidified (DS) or single-crystal (SX) techniques. Alternatives include non-directional equiax (EQ) casting.

The top plate and base plate are joined by a circumferential array of vertical supports 106 (e.g., threaded rods threaded into the top plate and bottom plate or otherwise secured thereto via fasteners). From top-to-bottom, the pattern comprises a wax member 112 having an upper portion 114 for ultimately forming a pour cone and a circumferential array of portions 116 depending from a base of the upper portion 114 for forming gating for passing molten metal from the pour cone to the portions of the ultimate shell that cast the individual parts. Depending from each of the portions 116 is a respective portion 118 representing a primary portion of an individual pattern 120 for forming an individual part. Thus, where the individual part is a combustor panel, the portion 118 is generally shaped as a combustor panel; where the individual part is a blade, the portion 118 is generally shaped as a blade; and so forth.

Additional gating 122 is formed at the base or lower end of the portion 118 atop the base plate 104. As is discussed further below, the portion 118 is relatively thin and/or has choke point interruptions formed by either narrowed areas or via cores. The thinness of the pattern, or the presence of the choke points, create difficulties for the evacuation of wax.

Additionally, the thinness of the pattern portion 118 may limit the strength of the ultimate shell therearound. For example, it may be impractical or undesirable to have a very thick shell providing sufficient ultimate structural integrity. Accordingly, an additional aspect which may exist independently of the thinned core portion or choke points, are the use of molded wax bodies 130 for forming isolated compartments in the shell. Showing around the bodies 130 creates additional layers or regions of the shell which provide structural integrity. Such molded wax bodies may be supported via a use of pre-formed ceramic pins or other structures (e.g., engaging portions of the ceramic feedcores protruding from the pattern portions 118). FIG. 2 shows ceramic rods 132 extending upward from the gating.

Figure 2A:
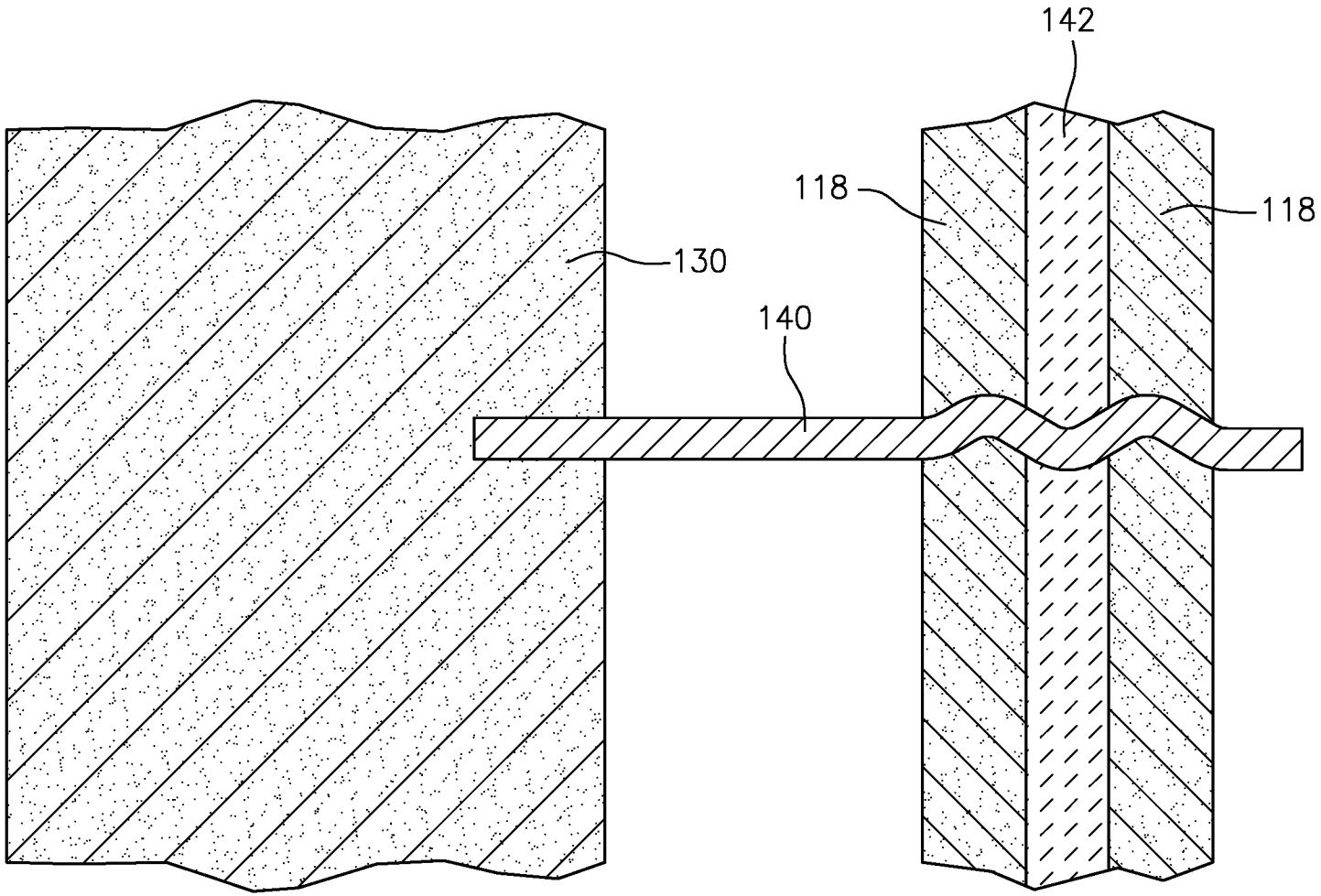
FIG. 2A is an enlarged view of a portion of the pattern assembly of FIG. 2.

For example, FIG. 2A shows the wax body 130 joined to the pattern portion 118 via cores 140 such as refractory metal wires. Additionally, an overmolded ceramic core 142 is shown within the pattern portion 118. The bodies 130 and pattern portions 118 may be assembled to each other by pre-drilling, cutting, melting, or molding holes into the pattern portion 130 to receive an end of the core 140. FIG. 2A is merely illustrative of one of numerous configurations that may be present. Examples of particularly thin articles include combustor panels. However, there may be many articles that have choke points, etc. hindering the evacuation of pattern wax by conventional means.

The pattern may then be shelled 34 (e.g., via one or more stages of slurry dipping, slurry spraying, or the like). After the shell is built up, it may be dried 36. The drying provides the shell with at least sufficient strength or other physical integrity properties to permit subsequent processing. For example, the shell containing the invested core assembly may be disassembled 38 fully or partially from the shelling fixture to ready it for dewaxing.

Figure 3:
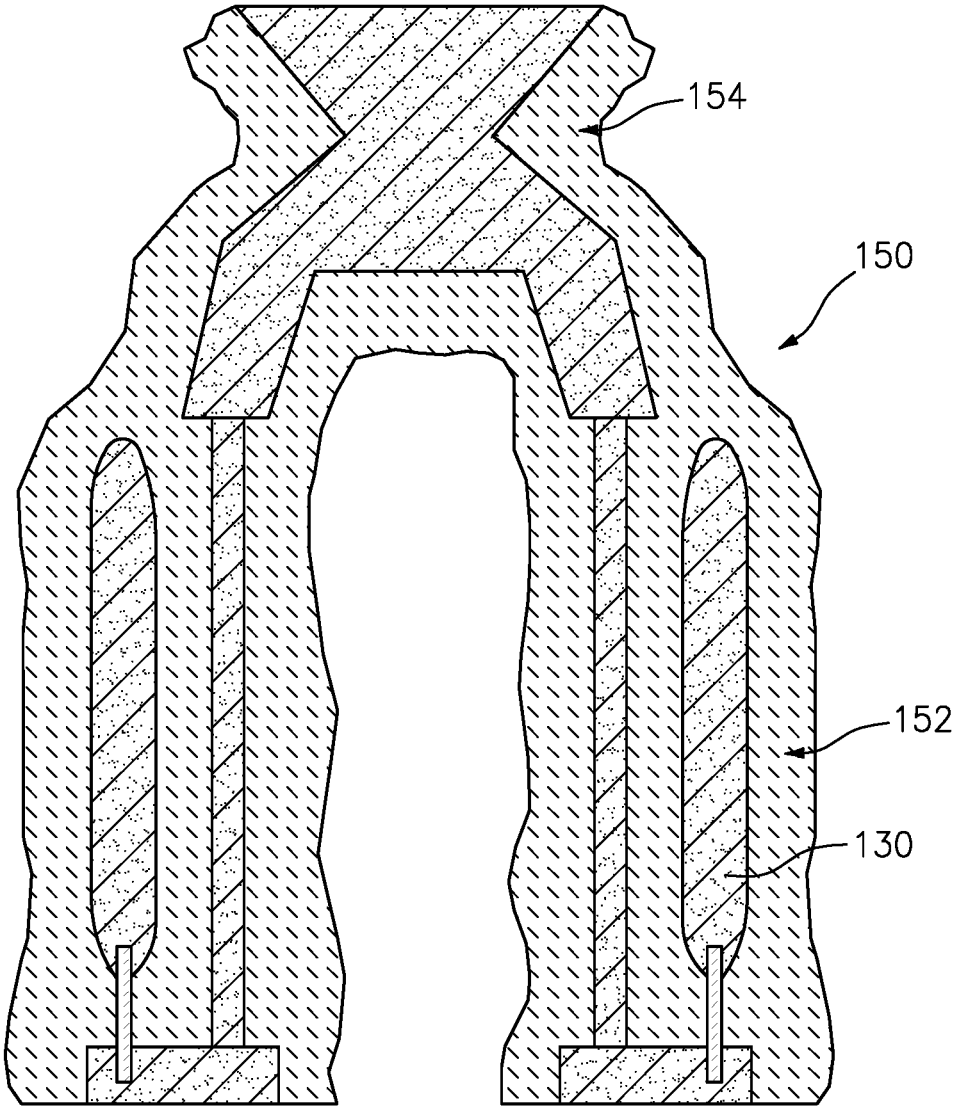
FIG. 3 is a partially schematic vertical sectional view of a shelled pattern.
Figure 5:
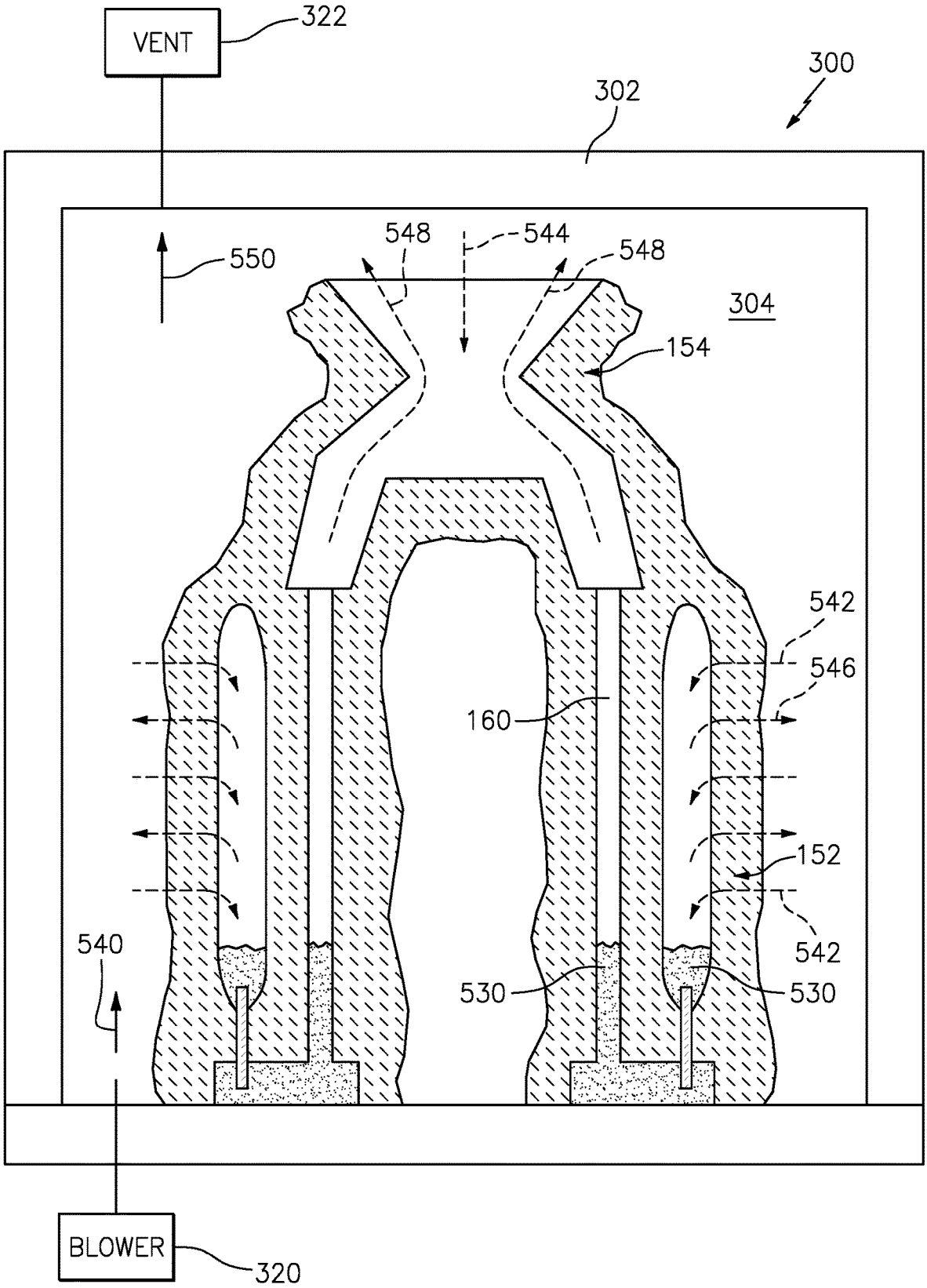
FIG. 5 is a partially schematic vertical sectional view of the shell during an oxidative heating.

FIG. 3 shows the shelled pattern after removal of the shelling fixture. From FIG. 3, it is seen how the presence of the bodies 130 have allowed the shell 150 to form with a more robust stucco structure 152 around the ultimate part-forming cavities (160 in FIG. 5) to better support the pour cup 154 and maintain mold integrity. From this view, it is seen that evacuating the wax of the bodies 130 appears impossible. Additionally, the thinness of the portion 118 and/or the presence of choke points mean that there may be sufficient resistance to wax evacuation that conventional autoclave heating expands the wax before it can evacuate. Such expansion deforms/damages the shell.

As is discussed further below, the dewaxing departs from traditional steam autoclave dewaxing. The shell and core assembly will largely form the ultimate mold. Depending on particular implementations, a separately-formed pour cup may be mated with the shell prior to casting. Similarly, multiple separate shell elements may be mated to a separately-formed manifold and separately-formed pour cup.

Figure 4:
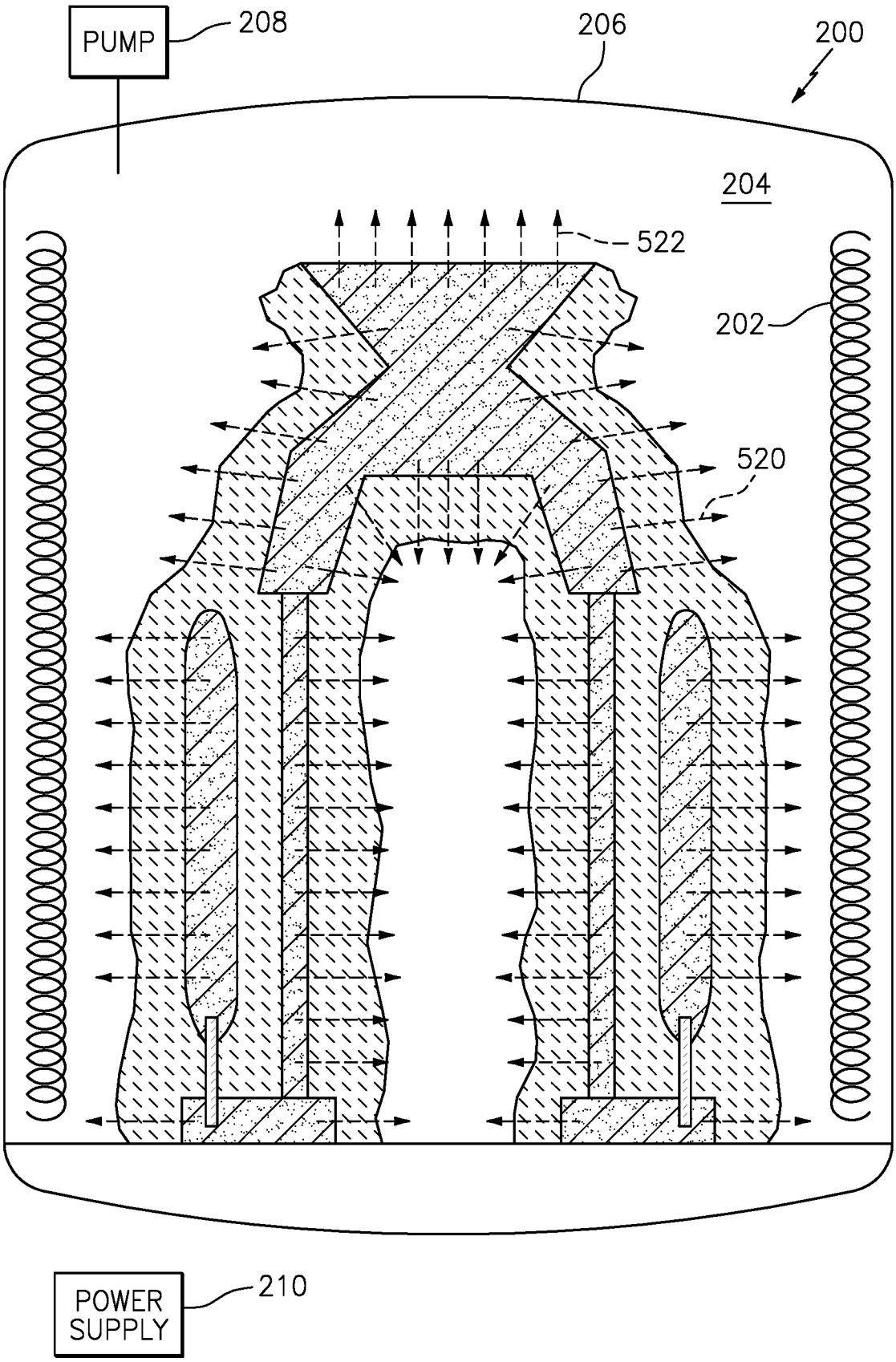
FIG. 4 is a partially schematic vertical sectional view of the shelled pattern during a vacuum heating.

The shell 150 is transferred 40 to a vacuum furnace 200 (FIG. 4). Exemplary vacuum furnaces include top- or side-loading vacuum furnaces with resistive or induction heating. Resistive heating entails heating by passing of current through a refractory conductive material 202 such as molybdenum or graphite heating elements (connected to a power supply 210) resulting in heat generation. Induction heating entails passing current through coiled conductor (not shown) to produce eddy currents in a conductor which in turn emits heat through radiation.

The interior 204 of the furnace vessel 206 is then pumped down via a one or more stage vacuum pump system 208. Exemplary pressure is less than $10^{-2}$ torr (1.3 Pa), more particularly less than 5.0 millitorr (0.67 Pa), or an exemplary $10^{-5}$ torr (1.3 mPa) to 5.0 millitorr (0.67 Pa) or $10^{-5}$ torr (1.3 mPa) to $10^{-2}$ torr (1.3 Pa). In the vacuum furnace the shell is heated 42 to a high temperature. Exemplary temperature involves a peak temperature of at least 1500° F. (816° C.), more particularly 1500° F. (816° C.) to 2000° F. (1093° C.) or 1750° F. (954° C.) to 2000° F. (1093° C.).

The heating 42 is effective to essentially reduce the wax to carbon by evaporation and pyrolysis. This leaves a much reduced volume of material within the shell. The temperature is sufficient for the polymer constituents to thermally degrade in a process referred to as chain scission. Briefly, the thermal energy is sufficient to break the bonds of the polymer chain. This thermal degradation results in release of free hydrogen and smaller hydrocarbons which evaporate passing (flow 520) through the porous shell and/or (flow 522) out one or more openings.

Because the pattern volatilizes and passes through the porous shell no wax flow path to the exterior of the mold is required. This enables features impossible with steam de-wax process including isolated wax bodies which become isolated cavities. Carbon-carbon bonding may occur during the process producing a residual cross-linked carbon material (530 in FIG. 5) with a greatly reduced volume form the original pattern.

The vacuum fire process requires high heat fluxes such that the surface areas of the wax pattern within the ceramic shell degrade and volatilize prior to heating through the entire wax pattern. If the shelled wax assembly were heated slowly the wax would expand and fracture the ceramic shell due to its higher coefficient of thermal expansion. Resistive heating in a vacuum environment is conducive to ensuring sufficiently rapid degradation and volatilization of the wax pattern. The heating elements quickly reach a high temperature and radiate at that temperature in the chamber. In the absence of atmosphere convection does not operate to distribute heat. This leads to a high heating rate at the surface of the mold facilitating rapid heating, degradation, and volatilization at the surface of the pattern.

The heating 42 may create a fired, but oxygen-poor condition of the shell surface.

After the heating 42, the shell is transferred 44 to a second furnace 300 (FIG. 5)(e.g., containing air or other oxidizing atmosphere) in which it is heated 46. This stage may have similar parameters to a conventional post-autoclave heating and the furnace 300 may be a traditional gas-fired mold kiln. Such kilns are typically used after a traditional de-wax process to fire a ceramic shell mold. In such kilns following conventional dewax, a separate blower 320 introduces air (flow 540) to the chamber 302 interior 304 to facilitate oxidation (burning) of residual wax. Similarly, in following the vacuum fire process 42 firing in a gas kiln with a separate blower will facilitate oxidation (burning) of any carbon residuals 530 in the shell. During this step oxygen will pass through the porous shell (flow 542) or openings (flow 544) into the cavities and oxidize any residual carbon to $CO_2$ which will pass out through the porous shell (flow 546) and/or openings (flow 548). Oxidation products and other vapor may pass (flow 550) out of the chamber such as through a vent 332.

Exemplary temperature is to a peak temperature of at least 1200° F. (649° C.), more particularly 1200° F. (649° C.) to 1800° F. (982° C.), or to 1400° F. to 1750° F. (760° C. to 954° C.). This does not need to be lower than the peak temperature of the heating 42.

Although nominally atmospheric, pressure may be below ambient pressure due to evacuation fans or blowers (not shown). Pressure may be above ambient pressure due to forced introduction of air (e.g., via fan or blower 320) or other oxygen-containing gas (e.g., from an oxygen tank) or from combustion products of a burner if internal. Similarly, oxygen partial pressures may become depleted slightly due to the oxidation process or venting or may be slightly elevated due to introduction of excess air or $O_2$. Consider Standard Pressure of 101.325 kPa. With 21% $O_2$ by volume, the oxygen partial pressure would be 21.3 kPa.

Thus, allowing for some variation in total pressure and greater variation in oxygen partial pressure, exemplary pressures are in a range of 80 kPa to 150 kPa, more broadly 70 kPa to 200 kPa. Exemplary 02 partial pressures are 10 kPa to 60 kPa or 15 kPa to 40 kPa.

Exemplary pressure differences between the minimum pressure during the heating 42 and during the heating 46 are at least 75 kPa, more particularly, at least 90 kPa or 75 kPa to 200 kPa. For purposes of reference, the pressures may be viewed as average (mean or median) over the respective intervals or as instantaneous values at some point in that interval (such as points at which specified temperatures occur).

The heating 46 burns off the carbon as carbon dioxide. Oxygen in the atmosphere reacts with the carbon to form carbon dioxide. Removal of the carbon is advantageous to reduce or eliminate the formation of detrimental carbides in the metal casting. Removing carbon offers the additional advantage of reducing the potential for clogging the vacuum pumps used in subsequent stages of operation. The heating 46 may also restore surface chemistry of the shell (add oxygen) to what is normally expected to provide conventional shell properties (e.g., wetting angles).

The mold may be removed from the atmospheric furnace, allowed to cool, and inspected 48. The mold may be seeded 50 by placing a metallic seed (not shown) in the mold to establish the ultimate crystal structure of a directionally solidified (DS) casting or a single-crystal (SX) casting. Nevertheless the present teachings may be applied to other DS and SX casting techniques (e.g., wherein the shell geometry defines a grain selector) or to casting of other microstructures (e.g., non-directional or equiax (EQ) casting) of various alloys including nickel- and/or cobalt-based superalloys. The mold may be transferred 52 to a casting furnace (e.g., placed atop a chill plate in the furnace). The casting furnace may be pumped down to vacuum 54 or charged with a non-oxidizing atmosphere (e.g., inert gas) to prevent oxidation of the casting alloy. The casting furnace is heated 56 to preheat the mold. This preheating serves two purposes: to further harden and strengthen the shell; and to preheat the shell for the introduction of molten alloy to prevent thermal shock and premature solidification of the alloy.

After preheating and while still under vacuum conditions, the molten alloy is poured 58 into the mold and the mold is allowed to cool to solidify 60 the alloy (e.g., after withdrawal from the furnace hot zone). After solidification, the vacuum may be broken 62 and the chilled mold removed 64 from the casting furnace. The shell may be removed in a deshelling process 66 (e.g., mechanical breaking of the shell).

The core assembly is removed in a decoring process 68 to leave a cast article (e.g., a metallic precursor of the ultimate part).

The exact nature of an appropriate decoring process 68 will depend on several factors. These factors include: the particular material(s) of the RMC(s), including any coating; the particular material(s) of any ceramic core(s); the particular casting alloy; and the core geometries. The materials provide various issues of effectiveness and compatibility with chemical and oxidative removal techniques. The geometry issues influence the accessibility and required exposures. Decoring may occur in one or more stages and may involve one or more of alkaline leaching, acid leaching, and thermal-oxidative mechanisms appropriate to the core material or material combination.

The cast article may be machined 70, chemically and/or thermally treated 72 and coated 74 (typically a multi-stage process including spray or vapor deposition of one or more metallic bond coat layers and one or more ceramic layers) to form the ultimate part. Some or all of any machining or chemical or thermal treatment may be performed before the decoring.

One or more embodiments have been described. Nevertheless, it will be understood that various modifications may be made. For example, the principles may be implemented as modifications of existing or yet-developed processes in which parameters of those processes would influence or dictate parameters of the implementation. Although discussed in the context of dewaxing, the process may be used to remove other carbon-containing pattern materials such as foams. Accordingly, other embodiments are within the scope of the following claims.

What is claimed is:

1. A method for removing a pattern material comprising a wax from a casting shell, the method comprising:
- a first heating; and
- a second heating after the first heating, wherein the first heating has a lower minimum pressure than the second heating, wherein:
- the first heating has a peak temperature of at least 816° C.

2. The method of claim 1 wherein:
- the first heating is at a minimum pressure of less than 1.3 Pa.

3. The method of claim 1 wherein:
- the first heating is at a lower median oxygen partial pressure than a median oxygen partial pressure of the second heating.

4. The method of claim 3 wherein:
- the first heating evaporates and pyrolizes the pattern material to leave carbon;
- the second heating oxidizes the carbon; and
- the pattern material consists essentially of wax.

5. The method of claim 1 wherein:
- the pattern material consists essentially of wax.

6. The method of claim 1 wherein:
- the first heating peak temperature is 816° C. to 1093° C.; and
- the second heating peak temperature is 649° C. to 982° C.

7. The method of claim 6 wherein:
- the first heating is in a first furnace; and
- the second heating is in a second furnace, different from the first furnace.

8. The method of claim 1 wherein:
- the shell contains a casting core.

9. The method of claim 8 wherein:
- the casting core is a ceramic casting core.

10. The method of claim 1 used to manufacture a gas turbine engine component.

11. A casting method including the method of claim 1 and further comprising:
- molding the pattern material over a casting core to form a pattern;
- forming the shell over the pattern;
- after the removing of claim 1, casting a metallic material in the shell around the casting core; and
- destructively removing the shell and casting core to leave a cast part.

12. The method of claim 11 wherein the cast part consists essentially of a nickel-based superalloy.

13. A method for removing a pattern material comprising a wax from a casting shell, the method comprising:
- a first step for evaporating and pyrolizing the pattern material to leave carbon; and
- a second step, for oxidizing the carbon.

14. The method of claim 13 wherein:
- the first step includes applying vacuum.

15. The method of claim 14 wherein:
- the second step includes introducing oxygen.

16. The method of claim 13 wherein:
- the first step comprises exposing the shell to a pressure of less than 1.3 Pa while at a temperature of at least 816° C.

17. The method of claim 16 wherein:
- the second step comprises exposing the shell to an oxygen partial pressure of at least 10 kPa while at a temperature of at least 649° C.

18. The method of claim 13 wherein:
- the pattern material consists essentially of wax.

19. The method of claim 18 wherein:
- the first step is in a first furnace; and
- the second step is in a second furnace, different from the first furnace.

20. The method of claim 13 wherein:
- the first step is in a first furnace; and
- the second step is in a second furnace, different from the first furnace.

* * * * *